US007347714B2

(12) United States Patent
Liang

(10) Patent No.: US 7,347,714 B2
(45) Date of Patent: Mar. 25, 2008

(54) ELECTRONIC DEVICE ASSEMBLY HAVING SECURING FEATURE

(75) Inventor: Jen-Yu Liang, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,029

(22) Filed: Jun. 12, 2006

(65) Prior Publication Data

US 2007/0134962 A1 Jun. 14, 2007

(30) Foreign Application Priority Data

Aug. 23, 2005 (CN) ..... 2005 1 0036808

(51) Int. Cl.
*H01R 13/64* (2006.01)

(52) U.S. Cl. ..... 439/374; 439/351; 439/345

(58) Field of Classification Search ..... 439/352, 439/351, 345, 374, 527
See application file for complete search history.

(56) References Cited

U.S. PATENT DOCUMENTS 4,097,113 A * 6/1978 McKelvy ..... 439/377
6,030,247 A 2/2000 Sasahara
6,638,113 B2 * 10/2003 Kajiwara et al. ..... 439/651
6,935,883 B2 * 8/2005 Oddsen, Jr. ..... 439/374
2002/0127898 A1 9/2002 Liu

* cited by examiner

*Primary Examiner*—Renee Luebke
*Assistant Examiner*—Vanessa Girardi
(74) *Attorney, Agent, or Firm*—Wei Te Chung

(57) ABSTRACT

An exemplary electronic device assembly includes a first electronic device and a second electronic device. The first electronic device includes a first sidewall, a first projecting portion projecting from the first sidewall, a pair of first spring fingers protruding from a surface of the first projecting portion, and a receiving groove defined in the first sidewall adjacent to the first projecting portion. The second electronic device includes a second sidewall, a second projecting portion projecting from the second sidewall, a pair of second spring fingers protruding from a surface of the second sidewall, and a latch portion projecting from the second sidewall and corresponding to the first projecting portion. The second projecting portion defines a receiving space. When the first projecting portion is received in the receiving space, the first spring fingers contact the second spring fingers.

12 Claims, 4 Drawing Sheets

ELECTRONIC DEVICE ASSEMBLY HAVING SECURING FEATURE

FIELD OF THE INVENTION

The present invention pertains to an electronic device assembly, and particularly to an electronic device assembly comprising a first electronic device firmly connected with a second electronic device.

DESCRITPION OF RELATED ART

Presently, electronic devices such as access points, WiFi repeaters, customer premises equipment and so on, require a direct-current power supply, so in order to use an alternating current source, a transformer is needed to convert the alternating current to direct current.

Referring to FIG. 4, a conventional communication device assembly is shown. The conventional communication device assembly includes an electronic device 10', a transformer 20', and a connecting member 30'. The connecting member 30' includes a plug A' electrically connecting with the electronic device 10', and a plug B' electrically connecting with the transformer 20'. However, there is no latching mechanism between the connecting member 30' and the plug A', and between the transformer 20' and the plug B', with a result that the plug A' and the plug B' may be easily pulled out of the transformer 20' and the electronic device 10' respectively resulting in no power supply.

Therefore, a need exists in the industry to overcome the aforementioned deficiencies and inadequacies.

SUMMARY OF THE INVENTION

In an exemplary embodiment, an electronic device assembly includes a first electronic device and a second electronic device. The first electronic device includes a first sidewall, a first projecting portion projecting from the first sidewall, and a receiving groove defined in the first sidewall adjacent to the first projecting portion. The second electronic device includes a second sidewall, a second projecting portion projecting from the second sidewall, and a latch portion projecting from the second sidewall corresponding to the receiving groove. The second projecting portion defines at least one receiving space for receiving the first projecting portion. The first electronic device is fixed with the second electronic device firmly, and they cannot be easily separated accidentally.

Other advantages and novel features will become more apparent from the following detailed description when taken in conjunction with the accompanying drawings, in which:

DETAILED DESCRIPTION OF THE INVENTION

Figure 1:
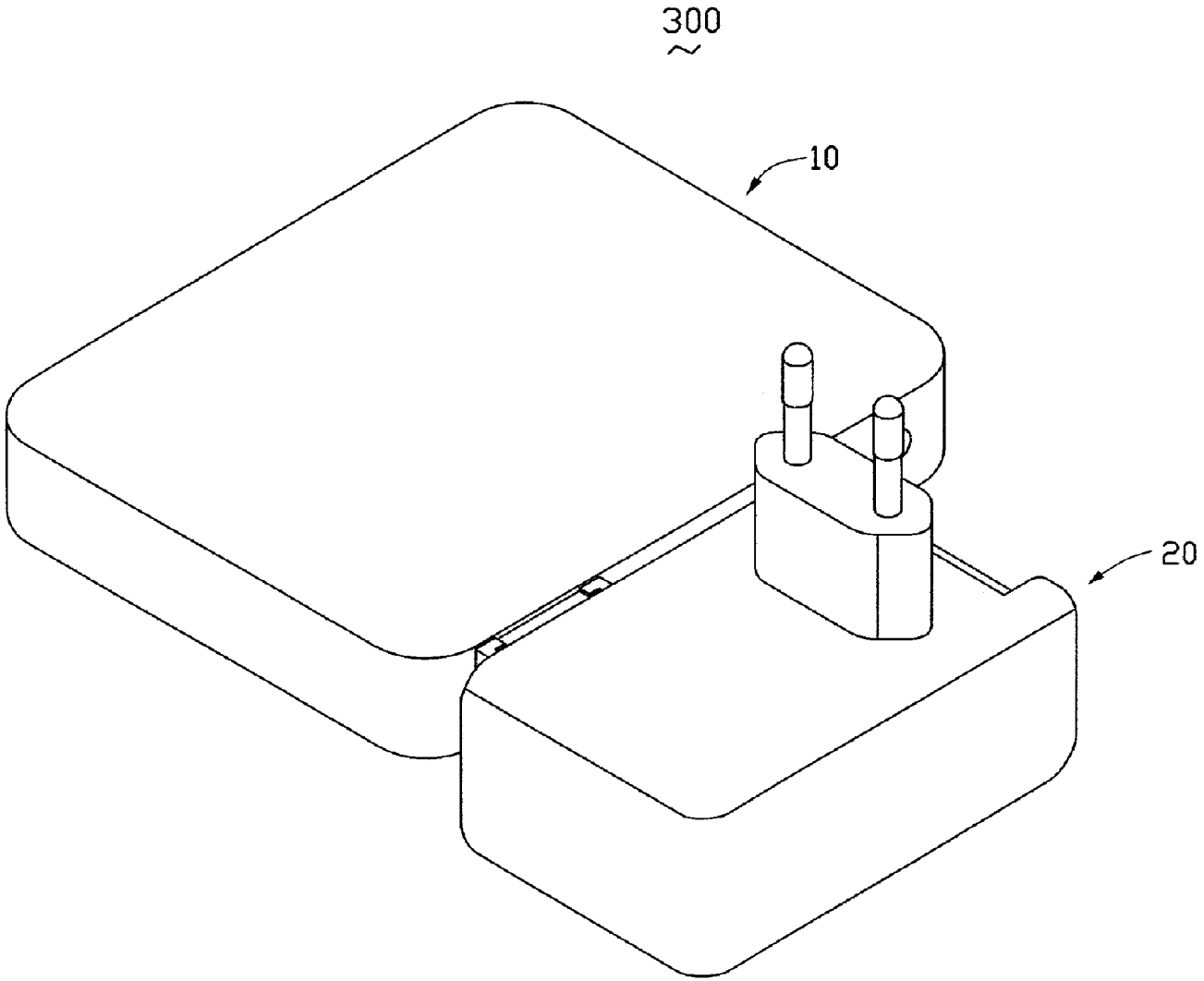
FIG. 1 is an assembled view of an electronic device assembly in accordance with an exemplary embodiment of the present invention, the electronic device assembly includes a first electronic device and a second electronic device.

Referring to FIG. 1, an electronic device assembly 300 in accordance with an exemplary embodiment of the present invention is shown. The electronic device assembly 300 includes a first electronic device 10 and a second electronic device 20.

Figure 2:
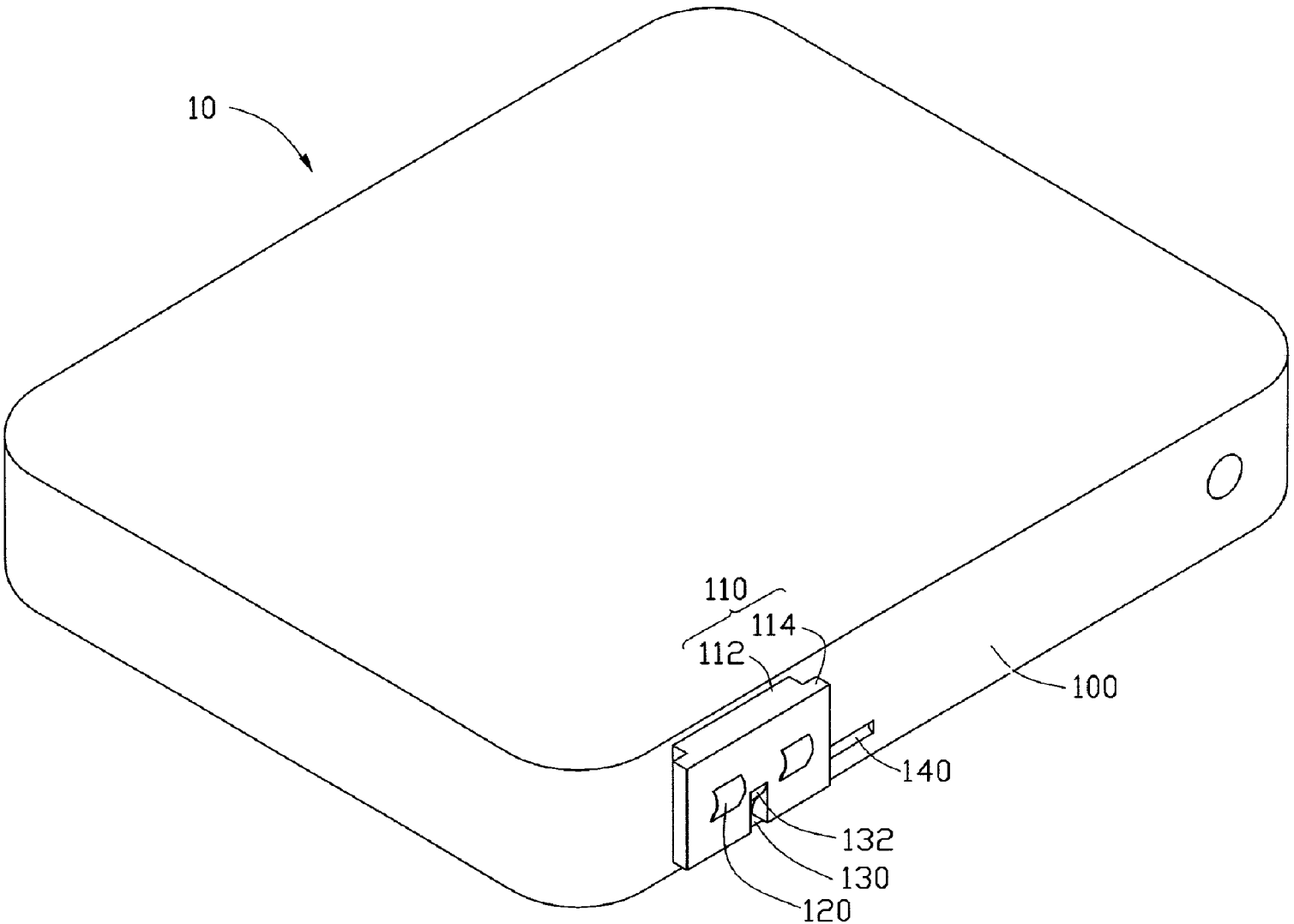
FIG. 2 is a perspective view of the first electronic device of FIG. 1.

In the exemplary embodiment, the first electronic device 10 can be an access point, a WiFi repeater, or so on. Referring to FIG. 2, the first electronic device 10 includes a first sidewall 100 and a first engaging means comprising a first projecting portion 110 protruding from the first sidewall 100. The first projecting portion 110 includes a connecting portion 112 and a fixing portion 114 integrally formed with the connecting portion 112. The connecting portion 112 vertically extending from the first sidewall 100. In the exemplary embodiment, the width of the fixing portion 114 is greater than that of the connecting portion 112. A pair of first spring fingers 120 of the first engaging means project from the fixing portion 114, and electrically connect with an inner circuit in the first electronic device 10. The fixing portion 114 defines a recessed portion 130 of the first engaging means therein with one end spanning a midst of an edge of the fixing portion 114, and another end forming an incline 132. A receiving groove 140 of the first engaging means is defined in the first sidewall 100 and is adjacent to one side of the first projecting portion 110.

Figure 3:
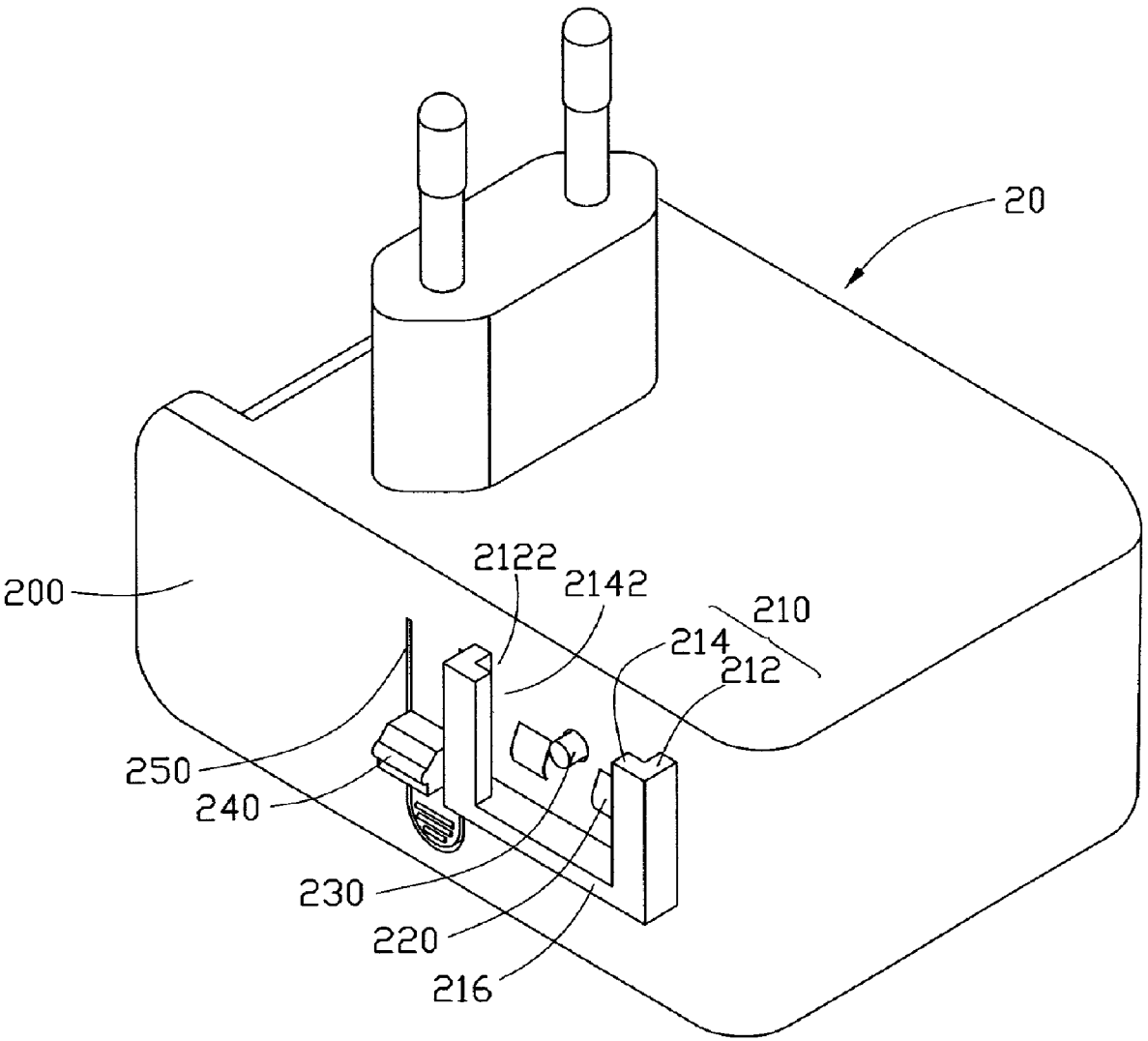
FIG. 3 is a perspective view of the second electronic device of FIG. 1.
Figure 4:
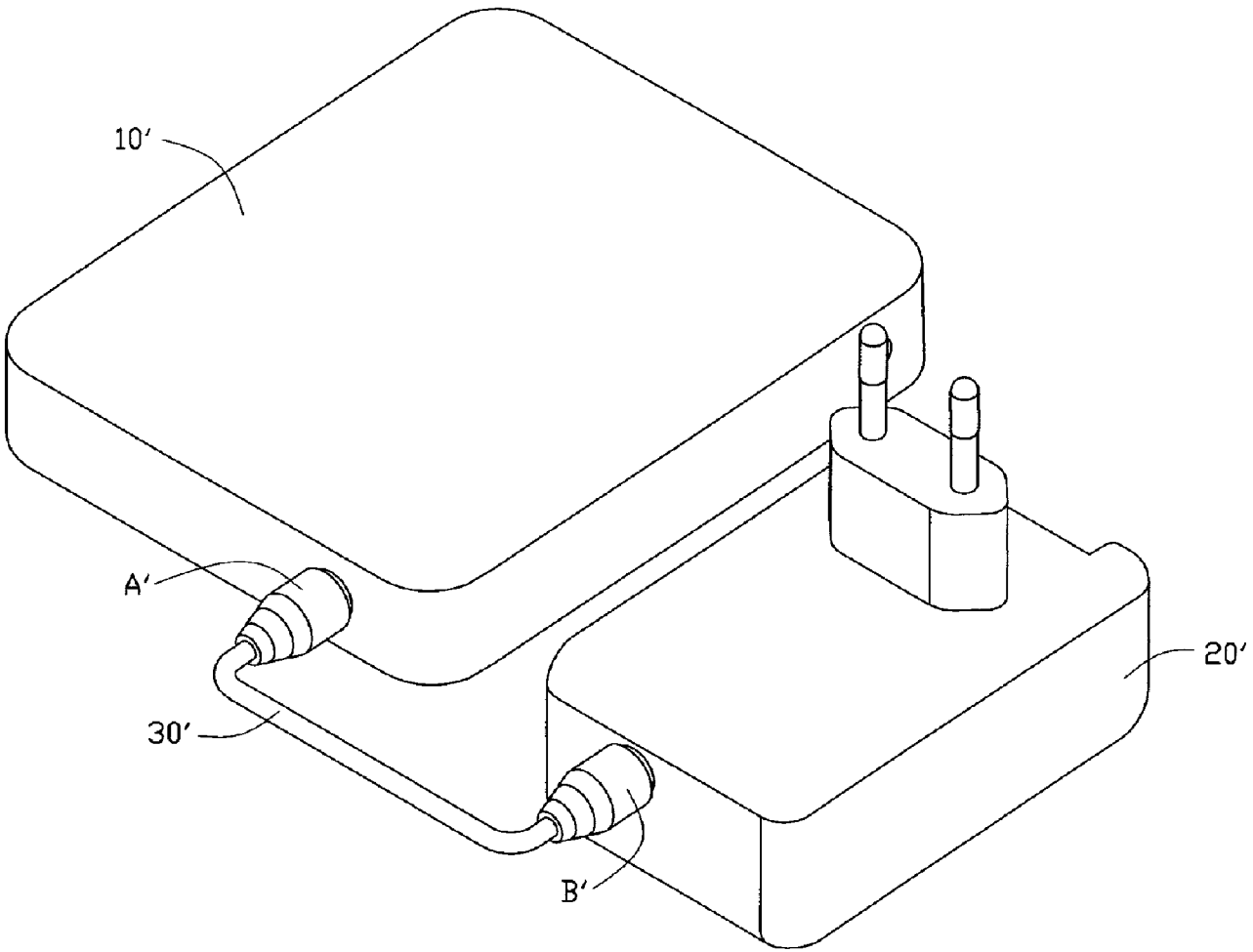
FIG. 4 (PRIOR ART)
FIG. 4 is an assembled view of a conventional electronic device assembly.

FIG. 3 shows a second electronic device 20 according to the exemplary embodiment. In the embodiment, the second electronic device 20 is used for providing power to the first electronic device 10. The second electronic device 20 includes a second sidewall 200 and a second engaging means, which comprises a second projecting portion 210 vertically protruding from the second sidewall 200, and a latch portion 240. The projecting portion 210 comprises two first protrusions 212, and two second protrusions 214 respectively and oppositely extending from the first protrusions 212. The first protrusions 212 define a first receiving space 2122 therebetween. The second protrusions 214 are formed across the first receiving space 2122, and define a second receiving space 2142 therebetween. The first receiving space 2122 is used for receiving the fixing portion 114, and the second receiving space 2142 is used for receiving the connecting portion 112. The projecting portion 210 further comprises a third protrusion 216, which extends between the two first protrusions 212 and the second protrusions 214, as a block for restricting the movement of the first projecting portion 110 when it is received in the first receiving space 2122 and the second receiving space 2142.

The second engaging means of the second electronic device 20 further comprises a pair of second spring fingers 220, a safety switch 230, and a latch portion 240. The second spring fingers 220 are fixed on the second sidewall 200 between the first protrusions 212, and respectively correspond to the first spring fingers 120. The safety switch 230 is actively configured in the second sidewall 200 and between the first protrusions 212, and is pressed when the fixing portion 114 of the first electronic device 10 is received in the first receiving groove 2122. The second spring fingers 220 electrically connect with an inner circuit in the second electronic device 20 only when the safety switch 230 is pressed. The latch portion 240 protrudes from the second sidewall 200 adjacent to the second projecting portion 210, and corresponds to the receiving groove 140. A U-shaped groove 250 is defined in the second sidewall 200 around the latch portion 240, allowing resilient movement of the latch portion 240 relative to the second sidewall 200.

In assembly, when the fixing portion 114 of the first electronic device 10 is inserted into the first receiving space 2122 of the second electronic device 20, the incline 132 slides along the safety switch 230 until the safety switch 230 is completely depressed relative to the second sidewall 200. And the latch portion 240 is pressed down relative to the second sidewall 200 and rebounds when aligned with and slides into the receiving groove 140, thereby preventing the projecting portion 110 of the first electronic device 10 from sliding back out of the projecting portion 210 of the second electronic device 20 without the latch portion 240 first being pressed. The fixing portion 114 and the connecting portion 112 are respectively received by the first receiving space 2122 and the second receiving space 2142.

In use, the first spring fingers 120 contact with the second spring fingers 220, and the safety switch 230 is completely pressed into the second sidewall 200 by the fixing portion 114, thereby the inner circuit in the first electronic device 10 and the inner circuit in the second electronic device 20 are electrically connected together.

The connecting portion 112 and the fixing portion 114 are respectively restricted in the second receiving space 2142 and the first receiving space 2122 by the cooperation between the latch portion 240 and the receiving groove 140, and the third protrusion 216. Thereby the first electronic device 10 is fixed with the second electronic device 20 firmly.

Because the second spring fingers 220 are connected to the inner circuit in the second electronic device 20 only if the safety switch 230 is completely pressed down relative to the second sidewall, the operator cannot get an electric shock from accidental contact with the second spring fingers 220.

Alternatively, the first electronic device 10 and the second electronic device 20 can be electrically connectable with each other by means of a cable. The cable comprises a connective end formed substantially same as the first engaging means of the first electronic device 10 in order to engage with the second engaging means of the second electronic device 20 for connection, and another connective end formed substantially same as the second engaging means of the second electronic device 20 in order to engage with the first engaging means of the first electronic device 10 for connection.

While an exemplary embodiment has been described above, it should be understood that it has been presented by way of example only and not by way of limitation. Thus the breadth and scope of the present invention should not be limited by the above-described described exemplary embodiment, but should be defined only in accordance with the following claims and their equivalents.

What is claimed is:

1. An electronic device assembly, comprising:

a first electronic device, comprising a first sidewall, and a first projecting portion protruding from the sidewall, and at least one first spring finger protruding from a surface of the first projecting portion; and a second electronic device, comprising a second sidewall, a second projecting portion protruding from the second sidewall, and at least one second spring finger, the second projecting portion defining at least one receiving space for receiving the first projecting portion, the at least one second spring finger received in the at least one receiving space and protruding from the second sidewall;

wherein when the first projecting portion is received in the at least one receiving space, the at least one first spring finger contact the at least one second spring finger;

such that the second sidewall further defines a latch portion integrated therewith, and a U-shaped groove around the latch portion in the second sidewall, the U-shaped groove allowing resilient movement of the latch portion ralative to the second sidewall, the first sidewall defining a receiving groove corresponding to the latch portion.

2. The electronic device assembly as claimed in claim 1, wherein the first projecting portion comprises a connecting portion vertically projecting from the first sidewall.

3. The electronic device assembly as claimed in claim 2, wherein the first projecting portion further comprises a fixing portion vertically protruding from the connecting portion.

4. The electronic device assembly as claimed in claim 3, wherein the second projecting portion defines a first receiving space for receiving the fixing portion therein.

5. The electronic device assembly as claimed in claim 4, wherein the second projecting portion further comprises a second receiving space which communicates with the first receiving space, the second receiving space for receiving the connecting portion therein.

6. The electronic device assembly as claimed in claim 1, wherein the second electronic device comprises a safety switch configured in the second sidewall, which is pressed relative to the second sidewall by the first projecting portion to electrify the second spring finger when the fixing portion is received in the first receiving space.

7. The electronic device assembly as claimed in claim 6, wherein the first projecting portion defines a recessed portion therein with one end spanning a midst of an edge of the fixing portion, and another end forming an incline as a slideway for the safety switch, and when the first projecting portion is being inserted into the at least one receiving space, the safety switch slides along a surface of the recessed portion until the safety switch is completely pressed relative to the second sidewall by the first projecting portion.

8. An electronic device assembly, comprising:

a first electronic device, comprising a first sidewall and first projecting portion protruding from the first sidewall, the first projecting portion comprising a connecting portion and a fixing portion vertically extending from the connecting portion, and a second electronic device, comprising at least two first protrusions, and at least two second protrusions respectively and oppositely extending from the first protrusions, the first protrusions defining a first receiving space therebetween for receiving the fixing portion therein, and the second protrusions formed across the first receiving space and defining a second receiving space therebetween for receiving the connecting portion therein; such that the first electronic device further defines a receiving groove adjacent to the connecting portion, and the second electronic device comprises a latch portion corresponding to the receiving groove;and the latch portion is entegrated with the second sidewall and a U-shaped groove is defined around the latch portion, the U-shaped groove allowing resilient movement of the latch portion relative to the second sidewall.

9. The electronic device assembly as claimed in claim 8, wherein the second electronic device further comprises a third protrusion which extends between the first protrusions as a block for restricting the movement of the fixing portion when it is received in the first receiving space.

10. The electronic device assembly as claimed in claim 8, wherein the fixing portion comprises at least one first spring finger, the second electronic device further comprises at Least one second spring finger configured between the second protrusions, and when the fixing portion is received in the first receiving space, the first spring finger contacts the second spring finger.

11. The electronic device assembly as claimed in claim 10, wherein the second electronic device further comprises a safety switch configured between the two second protrusions, the safety switch is pressed when the fixing portion is received in the first receiving space, and it is only when the safety switch is completely pressed that the second spring finger can be electrified.

12. The electronic device assembly as claimed in claim 11, wherein the fixing portion defines a recessed portion therein corresponding to the safety switch, with one end spanning a midst of an edge of the fixing portion, and another end forming an incline, and when the fixing portion is being inserted into the first receiving space, the safety switch slides along a surface of the recessed portion until the safety switch is completely pressed relative to the second sidewall by the first projecting portion.

* * * * *